US005419750A

United States Patent [19]

Steinmetz

[11] Patent Number: 5,419,750

[45] Date of Patent: May 30, 1995

[54] TRAINING AND EXERCISE MACHINE

[75] Inventor: Zeev Steinmetz, Ashdod, Israel

[73] Assignee: Sport's World Ltd., Ashdod, Israel

[21] Appl. No.: 146,844

[22] Filed: Oct. 21, 1993

Related U.S. Application Data

[63] Continuation of Ser. No. 834,844, Feb. 13, 1992, abandoned.

[30] Foreign Application Priority Data

Feb. 13, 1991 [IL] Israel ..... 97229

[51] Int. Cl.[6] ..... A63B 21/08

[52] U.S. Cl. ..... 482/111; 482/112; 482/72; 482/133

[58] Field of Search ..... 482/111, 112, 113, 114, 482/72, 97–102, 72–73, 58, 92, 121–123, 128–130; D21/193, 191, 198

[56] References Cited

U.S. PATENT DOCUMENTS

| | | | |
|---|---|---|---|
| D. 337,361 | 7/1993 | Engel et al. | D21/191 |
| 3,817,243 | 6/1974 | Perrine | 128/57 |
| 4,226,415 | 10/1980 | Wright | 272/130 |
| 4,729,562 | 3/1988 | Pipasik | 272/117 |
| 4,763,897 | 8/1988 | Yakata | 272/118 |
| 4,848,739 | 7/1989 | Schaub | 482/113 |
| 4,911,436 | 3/1990 | Lighter | 482/113 |
| 5,037,090 | 8/1991 | Fitzpatrick | 482/112 |
| 5,094,446 | 3/1992 | Weider | 482/72 |

*Primary Examiner*—Stephen R. Crow
*Assistant Examiner*—Jerome Donnelly
*Attorney, Agent, or Firm*—Jacobson, Price, Holman & Stern

[57] ABSTRACT

An exercising and training machine mainly for the abdominal part of the human body, and for building the abdominal muscles where reciprocating forward and back movement are performed against the power of an hydraulic piston.

5 Claims, 4 Drawing Sheets

TRAINING AND EXERCISE MACHINE

This application is a continuation of application Ser. No. 07/834,844, filed Feb. 13, 1992, now abandoned.

BACKGROUND OF THE INVENTION

The present invention relates to a foldable training and exercise machine especially for home use and more particularly to an abdominal cruncher bench.

Body exercise, body building, body shaping, body fitness and removing of excess weight has become very popular among the public, Due to the fact that nowadays many of the public have spare time, a relatively large number of country clubs were established, and even a great number of fitness centres and body shaping institutions were opened. Such establishments are equipped with various body building and exercise machines. Among these there are known multi trainer machines which have several working stations and other small machines for training of one or two parts of the body, such as hands, legs, shoulders etc.

The ever growing conscience of the public concerning health and the importance of exercising the body brought to the market all kinds of domestic exercising machines, some of which are multi purpose while others have one or two functions, Such machines or apparatus are described in U.S. Pat. Nos. 3,817,243, 4,226,415, 4,729,562 and 4,763,897. These machines and apparatuses are quite complex and of considerable size which makes some of them unusable as a domestic training apparatus.

OBJECTS OF THE INVENTION

Surveys have shown that the abdomen should be exercised before other parts of the body due to the tendency of the majority of the public to gain weight there and for the purpose of strengthening these muscles, However, fewer machines are available for this purpose.

It is thus the object of the present invention to provide a training and exercising machine mainly for the abdominal part of the human body.

It is a further object of the invention to provide a machine of relatively small size and of foldable build to enable its storing away when not in use.

It is yet a further object of the invention to provide a machine of double function.

It is yet another object of the invention to provide a machine which will not put stress on the spine during the exercise.

SUMMARY OF THE INVENTION

According to the invention there is provided a training and exercise machine comprising a chassis on which is mounted a seat, from said chassis extends substantially perpendicular an extension, to the free end thereof is pivotally connected an arm, one end thereof being bent approximately by 90° while to the other end is pivotally connected at least one hydraulic piston, the stem thereof is connected to said extension.

In the preferred embodiment two hydraulic pistons are connected, the stems thereof being attached to said arm via an intermediate member.

In a further preferred embodiment the legs of said chassis being foldable.

SHORT DESCRIPTION OF DRAWINGS

These and further advantages will be apparent from the following description with reference to the annexed drawings in which.

DESCRIPTION OF PREFERRED EMBODIMENT

Figure 1:
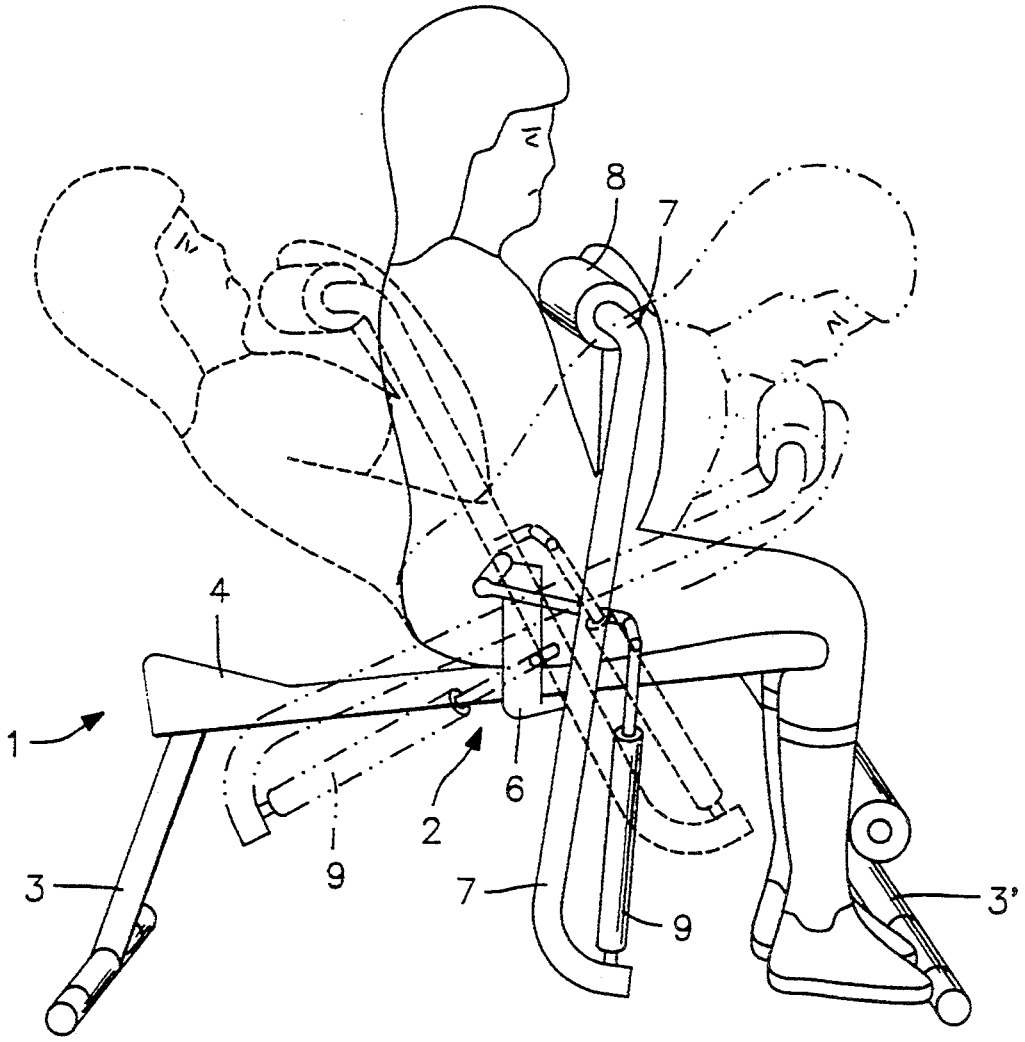
FIG. 1 is a side view of the machine illustrating the use of the machine.
Figure 2:
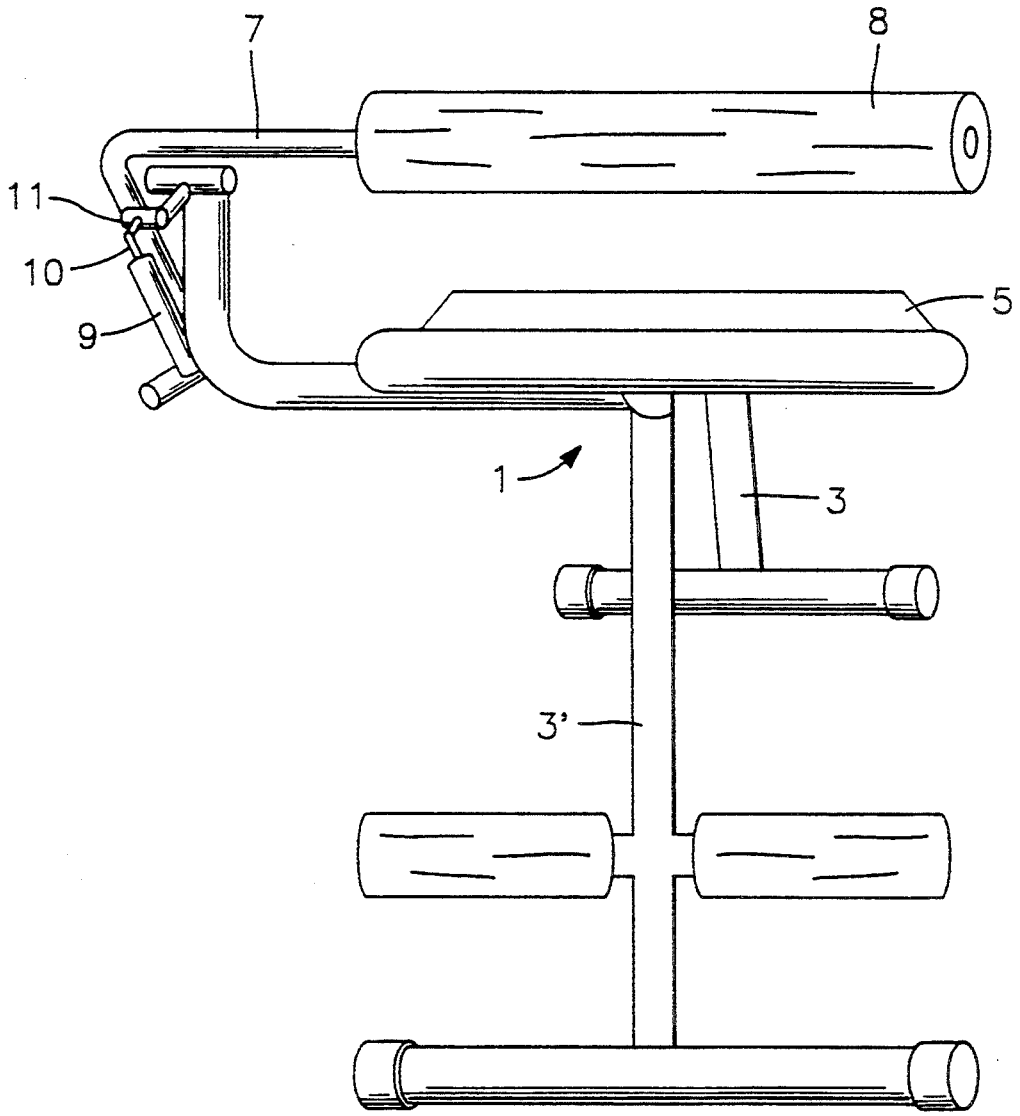
FIG. 2 is a frontal view thereof.
Figure 3:
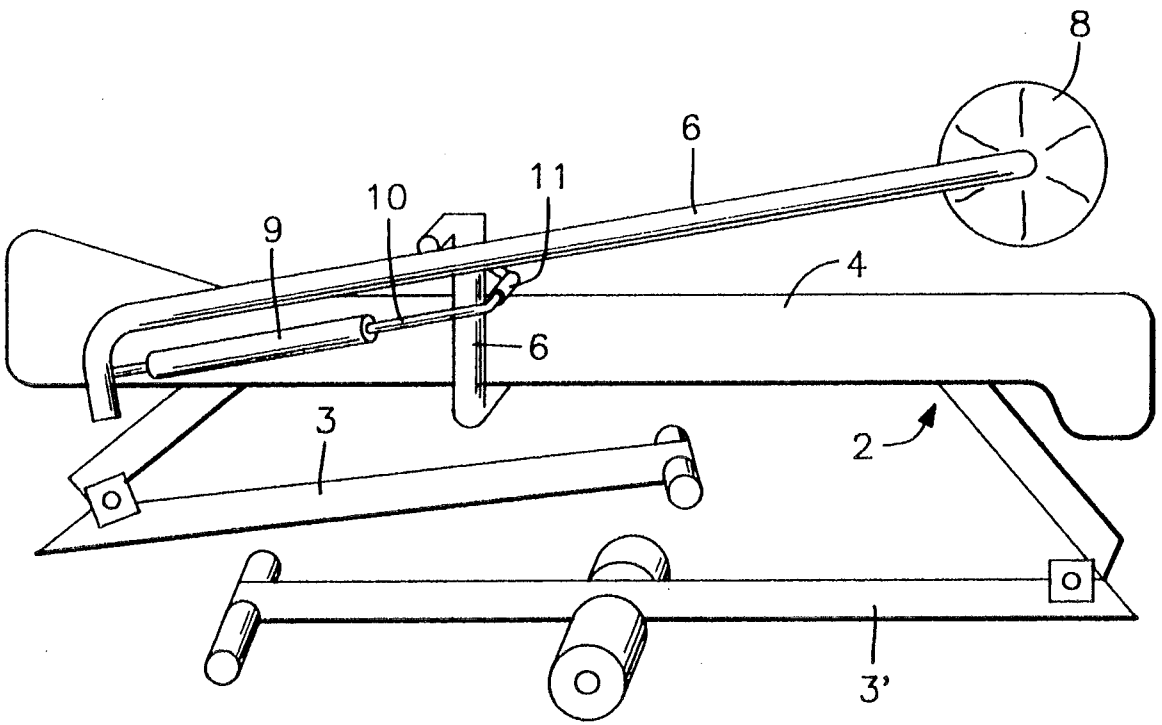
FIG. 3 is a side view of the machine in a folded position.

As can be seen, the machine according to the invention comprises a chassis 1 having a centre part 2, to both ends of which supports 3 and 3' are pivotally connected. In centre section 2 a seat 4 is placed preferably covered with upholstery 5. Perpendicular to said section 2 an extension 6 is connected, to the free end thereof is pivotally connected an arm 7. One free end of said arm is bent in the direction of seat 4, said bent section is preferably covered with upholstery 8. To the other free end of arm 7 is pivotally connected a hydraulic piston 9, the stem 10 thereof is connected to arm 7 at 11. On leg supports 3', foot pads are connected.

Figure 4:
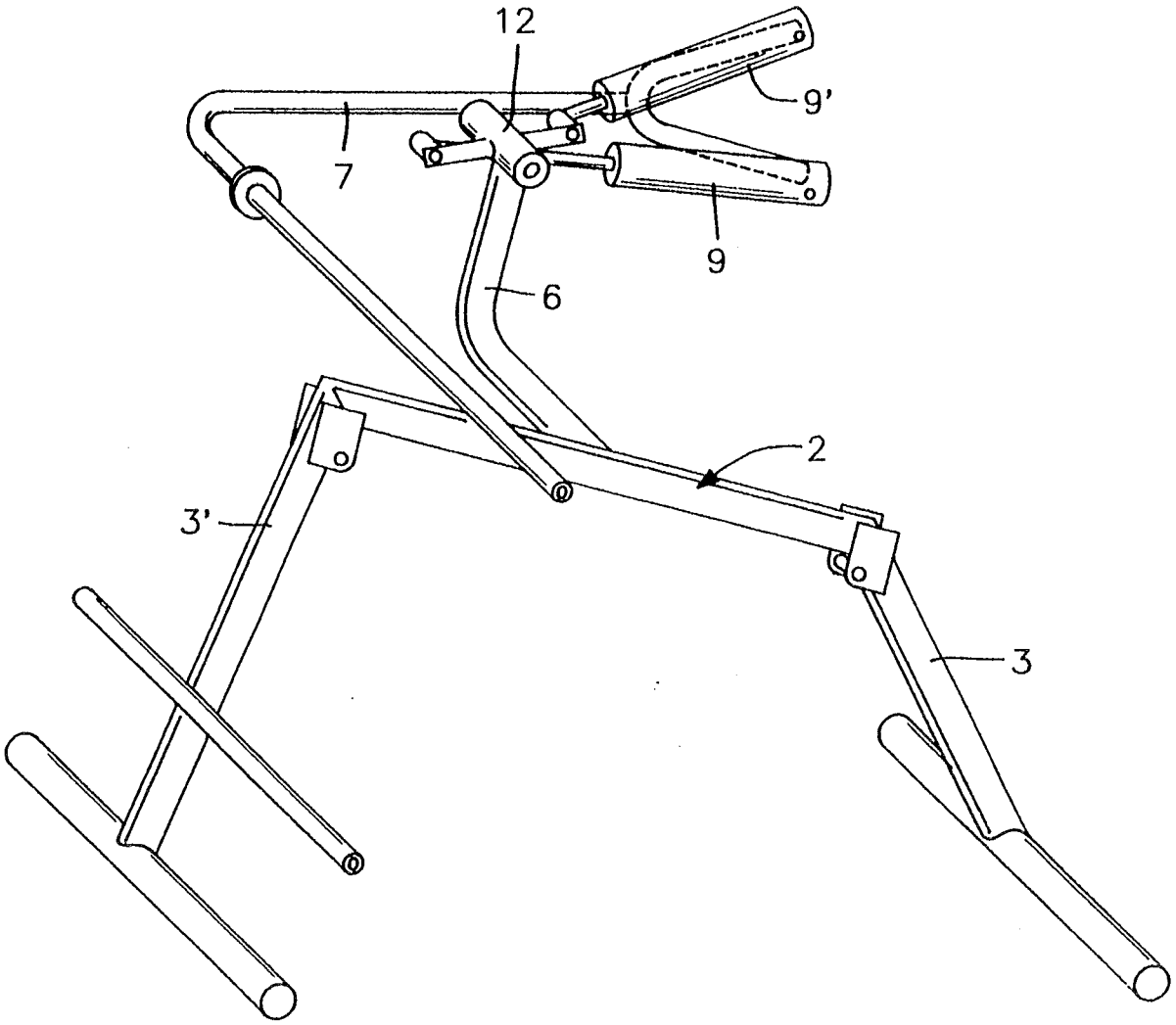
FIG. 4 illustrates a machine provided with two pistons.

FIG. 4 illustrates a preferred embodiment of the machine. To extension 6 an arm 7 is pivotally attached, the free end is provided with a fork like section, to the two ends thereof two hydraulic pistons 9 and 9' are connected. The two stems of said pistons are connected to extension 6 via intermediate member 12.

The machine is operated in a simple manner, the trainee sits on seat 4 as shown in FIG. 1, his legs are placed under the foot pads, the chest is placed against upholstery 8 of arm 7 and held with both hands, reciprocating forward and back movements are performed against the power of the hydraulic piston 9.

Due to the construction of the hydraulic piston 9, slow movements are easier to perform thus fast movements require more power than slow movements, which enables the trainee to adjust and control his or her training.

I claim:

1. A training and exercise machine comprising:

a chassis having a length and a width with said length being greater than said width, a seat mounted on said chassis, an extension member extending substantially perpendicular to said chassis from a middle of said length of said chassis, an arm pivotally connected to a free end of said extension member for reciprocal pivotal movement, one end of said arm being bent approximately by 90° to extend horizontally over said seat, at least one hydraulic piston pivotally mounted to the other end of said arm, a stem of said at least one hydraulic piston being pivotally connected to said extension member so that reciprocal pivotal movement of said arm by the hands of an operator grabbing said one of said arm adjacent to their chest when the operator is sitting on said seat and rocking movement of the operator sitting on said seat is against a resistive force of said at least one hydraulic piston.

2. A training and exercise machine as claimed in claim 1, wherein two pistons are provided at the other end of said arm.

3. A training and exercise machine as claimed in claim 1, wherein said chassis is provided with two foldable leg supports.

4. A training and exercise machine as claimed in claim 1, wherein said seat is covered with upholstery.

5. A training and exercise machine as claimed in claim 1, wherein said at least one hydraulic piston is adjustable.

* * * * *